United States Patent [19]

Edwards

[11] 4,286,653

[45] Sep. 1, 1981

[54] COAXIAL TUBE IN TUBE HEAT EXCHANGER WITH INNER TUBE SUPPORT

[75] Inventor: Ray C. Edwards, Kinnelon, N.J.

[73] Assignee: Edwards Engineering Corporation, Pompton Plains, N.J.

[21] Appl. No.: 170,547

[22] Filed: Jul. 21, 1980

[51] Int. Cl.[3] ..... F28D 7/14

[52] U.S. Cl. ..... 165/156; 165/178

[58] Field of Search ..... 165/154, 156, 178, 134 R

[56] References Cited

U.S. PATENT DOCUMENTS

| | | | |
|---|---|---|---|
| 2,270,864 | 1/1942 | Blais | 165/178 |
| 3,323,585 | 6/1967 | Cannon | 165/156 X |
| 3,945,431 | 3/1976 | Straub | 165/178 X |

FOREIGN PATENT DOCUMENTS

| | | | |
|---|---|---|---|
| 1269004 | 12/1961 | France | 165/178 |

*Primary Examiner*—Sheldon J. Richter
*Attorney, Agent, or Firm*—Daniel H. Bobis

[57] ABSTRACT

A coaxial tube in tube heat exchanger has at least one fluid tight connection for holding the outer tube, inner tube and a terminal connector in assembled position, and a support insert fixedly disposed in the inner tube for operative alignment with the fluid tight connection to permit use of a relatively thin walled inner tube for said heat exchanger.

6 Claims, 7 Drawing Figures

COAXIAL TUBE IN TUBE HEAT EXCHANGER WITH INNER TUBE SUPPORT

BACKGROUND OF THE INVENTION

In heat exchange systems or equipment such as air conditioning and refrigeration circuits, the use of a coaxial tube in tube heat exchanger is a known expedient and such devices are easily purchaseable on the open market such as the devices manufactured and sold by Edwards Engineering Corporation of Pompton Plains, New Jersey.

Such coaxial tube in tube heat exchangers include generally an elongated continuous outer tube of predetermined length, an elongated continuous inner tube having a length slightly greater than the outer tube lying coaxially in the longitudinal line of the outer tube and extending out of the opposite ends thereof, said outer tube and inner tube defining an annular fluid flow passage therebetween, and a terminal inlet connection for one end of said annular fluid flow passage and a terminal outlet connection spaced from the inlet connection for the opposite end of said annular fluid flow passage. These elements are brazed together generally at opposite ends of the outer tube and then the coaxial units are rolled or turned into various desired shapes such as spirals, toroids, helixes, trombones, etc. for the particular application to which they will be put. In the operation of these devices cooling fluid passes through the inner tube and gas to be condensed is passed in counter current flow through the annular fluid flow passage, the condensate flowing from the terminal outlet connection.

In order to increase the efficiency of these condensers, the inner tube for the greater length thereof is spirally wound with radially extending fins which are solder bonded to the outer surface of the inner tubes to provide metallic bonding of the fins thereto. Further the pitch of the spirally wound fins is such that a predetermined gap is established between each successive spiral to optimize both the bending and forming of the selected shape of the condenser and for insuring proper drainage of condensate from the annular fluid flow passage. My U.S. Pat. Nos. 2,661,525, 2,635,571 and 2,529,945 show and describe this type of finned tubing.

In order to establish and insure safe operating conditions various commercial regulations have been established for pressure vessels and a product to be commercially viable must be tested and certified by the Underwriters Laboratory which is the commercial agency qualified to give these certifications. Such approval and certification is granted based on various standardized hydraulic tests to which such pressure vessels are subjected. The tests which are applied to coaxial tube in tube heat exchangers require the vessel walls to withstand pressures in excess of five times the pressures normally met during ordinary operating conditions. For these heat exchangers the highest operating pressure is about 400 P.S.I.G. Accordingly, the walls of the tubular members and joints in these heat exchangers must be able to withstand, under test, hydraulic pressures in excess of 2000 P.S.I.G.

Heretofore when such tests have been applied to the known prior art type of coaxial tube in tube heat exchangers, due to the collapse of the inner tube under these pressures, ruptures have resulted more particularly at the brazed joints which hold the outer tube, inner tube and terminal connectors in assembled position.

In order to meet the pressures such heat exchangers must withstand particularly in the standardized hydraulic tests, it has been accepted prior art practice to increase the wall thickness of the copper or cupronickel inner tube being utilized in such coaxial tube in tube heat exchangers. Due to the increase in the cost of the materials for manufacturing the tubes from which such heat exchangers are manufactured this practice obviously increases the overall cost of such coaxial tube in tube heat exchangers.

In the present invention this problem is overcome by providing a support insert of sufficient length in the inner tube in operative alignment with the associated brazed connection for connecting the outer tube, the inner tube and the terminal fitting at a given end of the coaxial tube in tube heat exchanger.

This construction not only overcomes the problem but provides the additional advantage of permitting the wall thickness of the inner tube to be materially reduced which factor produces a substantial reduction in the overall manufacturing costs for such coaxial tube in tube heat exchangers.

SUMMARY OF THE INVENTION

Thus the present invention covers a coaxial tube in tube heat exchanger having an elongated continuous outer tube of predetermined length, an elongated continuous inner tube having a length slightly larger than the predetermined length of the outer tube and disposed in coaxial relation with said outer tube to define an annular fluid flow passage therethrough, said inner tube having an inlet for cooling medium at one end and an outlet for the cooling medium at the opposite end. The terminal inlet connector at one end of said coaxially disposed inner tube and outer tube is disposed in communication with the inlet end of the fluid flow passage to deliver a fluid medium to be condensed therein and the terminal outlet connector at the opposite end of said coaxially disposed inner tube and outer tube is disposed in communication with the outlet end of said fluid flow passage remote from the inlet end to pass condensed fluid medium from said heat exchanger, a first brazed connection for connecting said outer tube, inner tube and terminal inlet connector in fluid tight relationship, a second brazed connection for connecting the outer tube, the inner tube and terminal outlet connector in a fluid tight connection, a first support insert in said inner tube at said first connection, and a second support insert in said inner tube at said second connection whereby the wall thickness of the inner tube can be relatively thin for said heat exchanger.

Accordingly it is an object of the present invention to provide an improved coaxial tube in tube heat exchanger in which an inner support is provided for the inner tube to enable said inner tube to withstand the pressures exerted in said heat exchanger during the commercial tests thereon.

It is another object of the present invention to provide an improved coaxial tube in tube heat exchanger in which support insert is provided for the inner tube to permit the inner tube to have a relatively thin wall thickness.

It is another object of the present invention to provide an improved coaxial tube in tube heat exchanger in which the cost of manufacture is essentially maintained or reduced despite the increase of raw material for the elements thereof.

It is another object of the present invention to provide an improved coaxial tube in tube heat exchanger in which reduction in the cost of manufacture does not impair the safety regulations required on this device as a pressure vessel.

With these and other objects in view the invention consists of various features and combination of parts which will be described in connection with the accompanying drawings showing one preferred form of the invention.

DESCRIPTION OF THE FIGURES

Referring to the drawings FIG. 1 shows a helix type coaxial tube in tube heat exchanger generally designated 10.

FIGS. 1 to 6 show that the heat exchanger 10 includes an elongated continuous outer tube 11 having a predetermined length, an elongated continuous inner tube 12 having a continuous length greater than the length of the outer tube 11 so that it extends beyond the opposite ends of the outer tube 11 to form an inlet as at 13 and an outlet as at 14 for passing cooling medium therethrough. The inner tube 12 has spirally wound radially extending fins 15 to increase the heat exchange efficiency thereof and is disposed in the outer tube so that it lies coaxially with the longitudinal line of the outer tube 11 to define a generally annular longitudinally extending fluid flow passage or space 16 between the inner tube 12 and the outer tube 11.

Figure 1:
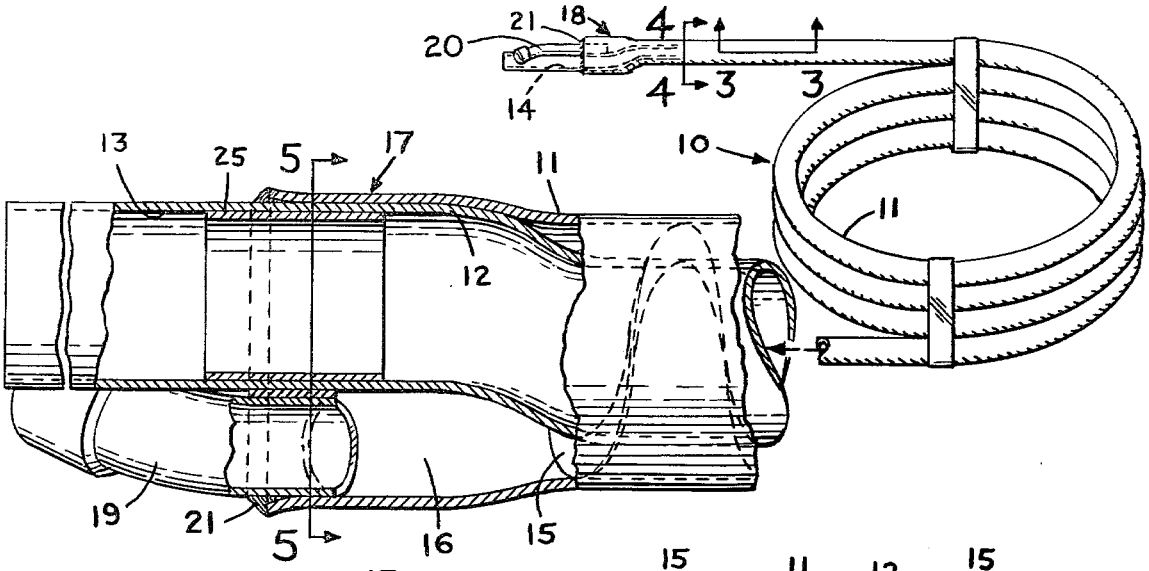
FIG. 1 is a side elevational view of a helix type coaxial tube in tube heat exchanger with one terminal end enlarged and shown partly in section.
Figure 2:
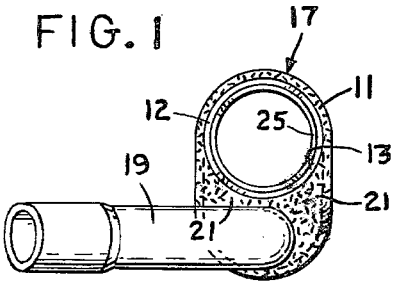
FIG. 2 is an end view of the enlarged terminal and shown in FIG. 1.
Figure 3:
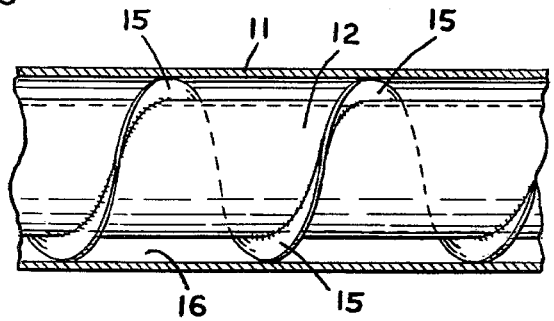
FIG. 3 is an enlarged fragmentary longitudinal section taken on line 3—3 of FIG. 1 showing the outer tube, the inner tube, the spiral finned tubing on the inner tube and the annular fluid flow passage formed between the outer tube and the inner tube.
Figure 4:
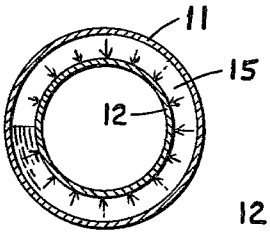
FIG. 4 is an enlarged cross section taken on line 4—4 of FIG. 1.
Figure 6:
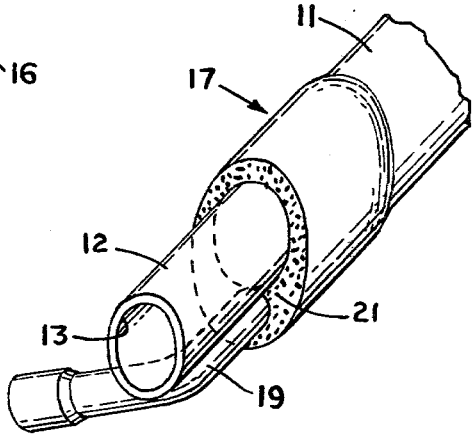
FIG. 6 is a perspective view of the enlarged terminal end shown in FIG. 1.

The outer tube 11 is preferably made of generally standard stock carbon steel tubing having a wall thickness of about 0.047" and will have the respective opposite ends as at 17 and 18 formed into an oval shape in end view and slightly belled to facilitate the mounting of the terminal inlet fitting 19 in one end between the outer tube 11 and the adjacent portion of the inner tube assembly 12 and terminal outlet fitting 20 between the opposite end of the outer tube 11 and its adjacent portion of the inner tube 12 and further to permit the formation of a first brazed connection 21 to hold the outer tube 11 associated portion of inner tube 12 and terminal inlet fitting 19 in assembled position and a second brazed connection 22 to hold the outer tube 11, associated portion of the inner tube 12 and the terminal outlet fitting 20 in assembled position as is shown in FIGS. 1, 2, and 6 of the drawings. The terminal inlet fitting 19 communicates with one end of the annular fluid flow passage 16 and the terminal outlet fitting 20 communicates with the annular fluid flow passage at the opposite or remote end from the terminal inlet fitting 19 so that a gas to be condensed can be passed in countercurrent noncontacting heat exchange relation with the inner tube assembly 12 and the fins 15 thereon.

This construction is substantially similar to that of the known prior art devices and hence is not more fully described.

In the present invention however the inner tube 2 will include standard stock copper or cupronickel tubing for handling the cooling water which has a wall thickness relatively thinner by approximately one-half that of the prior art devices and therefore will be in a range from 0.022" to 0.035" and preferably about 0.025" in thickness. Inner tube 12 will vary within this range depending upon the O.D. and I.D. of the inner tube for a given size heat exchanger or the application to which a particular heat exchanger may be utilized.

SUPPORT INSERT FOR INNER TUBE

In order to provide extra support to the inner tube 12 to prevent rupture thereof in the vicinity of the respective brazed joints 21 and 22 as has heretofore occurred in the prior art devices, a sized support insert 25 is fixedly positioned in the inner tube 12 so that the medial portion thereof lies in substantial alignment with the plane of the associated brazed joint 21 or 22 as the case may be transverse to the longitudinal axis of the outer tube 11. The support insert 25 being sized so that it will extend parallel to the longitudinal line of the outer tube 11, a sufficient distance to prevent the inner tube 12 from rupturing in the event that the same collapses either during operation or under test conditions.

Figure 5:
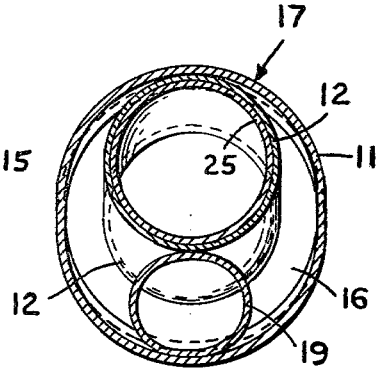
FIG. 5 is a cross-section taken at line 5—5 of the enlarged terminal end of the coaxial tube in tube heat exchanger shown in FIG.1.
Figure 7:
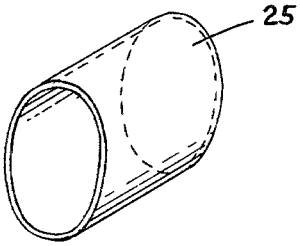
FIG. 7 is an enlarged view of the support insert shown in FIGS. 1 and 5 of the drawings.

FIGS. 1, 5, and 7 illustrate one form of insert 25 as comprising a copper or cupronickel nipple which has a wall thickness approximately the same as that of the inner tube 12 and which will have an initial diameter approximately 0.010" less than the inner diameter of inner tube 12 so that the support insert 25 can be positioned inside the inner tube at the desired location for alignment with the associated brazed joint and then expanded by means of suitable tooling, as will be understood by those skilled in the art, so as to achieve an interference fit fixing it in assembled position in the inner tube at the exact point where this support is needed to prevent rupture from occurring as has occurred in prior art devices of this type.

Use of the support insert permits an inner tube of lesser wall thickness to be utilized in the coaxial tube in tube heat exchangers in accordance with the present invention and therefore acts to reduce or as a minimum to maintain the cost of manufacture of such heat exchangers.

Thus an improved coaxial tube in tube heat exchanger which helps to conserve our natural resources and maintain the price structure has been above described.

It will be understood that the invention is not to be limited to the specific construction or arrangement of parts shown but that they may be widely modified within the invention defined by the claims.

What is claimed is:

1. In a coaxial tube in tube heat exchanger;

a. an outer tube b. an inner tube coaxial with the outer tube to form an annular fluid flow passage between the inner tube and the outer tube, c. at least one terminal connector disposed for communication with said fluid flow passage, d. at least one fluid tight connection for holding the outer tube, the inner tube and the terminal connector in assembled position, e. at least one support unit in the inner tube operatively aligned with each of the fluid tight connections.

2. In a coaxial tube in tube heat exchanger as claimed in claim 1 wherein the inner tube has a wall thickness which is relatively thin.

3. In a coaxial tube in tube heat exchanger as claimed in claim 1 wherein the wall thickness of the inner tube is in a range from 0.022" to 0.035" as a function of the O.D. and I.D. of the inner tube.

4. In a coaxial tube in tube heat exchanger as claimed in claim 1 wherein the wall thickness of the inner tube is 0.025" for a standard stock tube having an outer diameter of approximately $\frac{3}{4}$".

5. In a coaxial tube in tube heat exchanger as claimed in claim 1 wherein;

a. said outer tube has an oval shape and is slightly belled at the end where said fluid tight connection is made, and b. the fluid tight connection is made by brazing the outer tube, the inner tube and the terminal connector into assembled position.

6. A coaxial tube in tube heat exchanger comprising, a. an elongated continuous first tube having a predetermined length, b. an elongated continuous second tube disposed coaxially in and along the longitudinal axis of said first tube to define an annular space therebetween, c. said second tube having a length greater than said first tube and disposed to extend out of opposite ends thereof to provide an inlet for cooling medium at one end and an outlet for cooling medium at the opposite end, d. an inlet fitting connected into one end of said first tube for communication with one end of said annular fluid flow passage between the outer tube and the inner tube, e. an outlet fitting connected to the opposite end of said first tube and in communication with the opposite end of said annular fluid flow passage, f. means defining a brazed joint at each respective end of said first tube for connecting said first tube, said second tube and said inlet fitting at one end and for connecting said first tube, said second tube and said outlet fitting to the opposite end of said first tube, and g. support insert means fixedly mounted in engagement with said inner tube in operative alignment with each of the respective brazed joints for connecting the first tube, the second tube and the respective inlet and outlet fittings in assembled position in said heat exchanger.

* * * * *